US008499931B2

(12) United States Patent
Hsi et al.

(10) Patent No.: US 8,499,931 B2
(45) Date of Patent: Aug. 6, 2013

(54) NESTING WHEEL PACKAGING SYSTEM

(75) Inventors: Chris Hsi, Farmington Hills, MI (US); Xingxiang Zhang, Nanjing (CN); Eric Qu, Nanjing (CN); YuQian Jiang, Nanjing (CN)

(73) Assignee: Ford Global Technologies, LLC, Dearborn, MI (US)

( * ) Notice: Subject to any disclaimer, the term of this patent is extended or adjusted under 35 U.S.C. 154(b) by 269 days.

(21) Appl. No.: 11/947,494

(22) Filed: Nov. 29, 2007

(65) Prior Publication Data

US 2009/0139885 A1 Jun. 4, 2009

(51) Int. Cl.
*B65D 85/02* (2006.01)

(52) U.S. Cl.
USPC ..... 206/303; 206/499

(58) Field of Classification Search
USPC ..... 206/303, 304, 516, 335, 597, 499, 206/505, 504, 503, 445, 318, 821, 585, 515, 206/519; 220/23.89, 23.83, 23.86
See application file for complete search history.

(56) References Cited

U.S. PATENT DOCUMENTS

| | | | | |
|---|---|---|---|---|
| 478,954 | A * | 7/1892 | Davis | 206/335 |
| 1,383,779 | A * | 7/1921 | Workman | 206/514 |
| 1,523,510 | A | 1/1925 | Bray | |
| 2,447,206 | A | 8/1948 | Price | |
| 2,825,488 | A * | 3/1958 | Nelson | 221/67 |
| 3,028,003 | A * | 4/1962 | Keder et al. | 206/335 |
| 3,358,878 | A * | 12/1967 | Ostborg et al. | 206/514 |
| 3,658,176 | A | 4/1972 | Reid | |
| 4,076,319 | A * | 2/1978 | Walker | 301/1 |
| 4,998,619 | A * | 3/1991 | Sowa et al. | 206/392 |
| 5,048,688 | A | 9/1991 | Hicks, Jr. | |
| 5,743,391 | A * | 4/1998 | Hsiao | 206/303 |
| 5,762,195 | A * | 6/1998 | Stevens | 206/499 |
| 5,769,229 | A | 6/1998 | Andress et al. | |
| 5,826,716 | A * | 10/1998 | Wilson | 206/304 |
| 5,887,718 | A * | 3/1999 | Oslin et al. | 206/499 |
| 6,044,974 | A | 4/2000 | Webb et al. | |
| 6,484,877 | B1 | 11/2002 | Murakami et al. | |
| 6,971,518 | B1 * | 12/2005 | Lowry | 206/386 |
| 6,997,331 | B2 * | 2/2006 | Lobe | 211/59.4 |
| 7,546,922 | B2 * | 6/2009 | Howard | 206/445 |
| 2006/0070907 | A1 | 4/2006 | O'Shea | |
| 2007/0138037 | A1 * | 6/2007 | Hasenbusch | 206/303 |

* cited by examiner

*Primary Examiner* — J. Gregory Pickett
*Assistant Examiner* — Robert Poon
(74) *Attorney, Agent, or Firm* — Shook Hardy & Bacon LLP

(57) ABSTRACT

A nesting wheel packaging system is provided. The system includes an arrangement whereby a smaller wheel is nested substantially within a larger wheel. The wheels have a partition disposed therebetween to prevent damage. A plurality of sets of nested wheels is provided on a lower panel and an upper panel is positioned over the wheels to define a first layer or segment of wheels. Thereafter another layer of nested wheels is placed on top of the first layer or segment. The panels may have recessed areas defined therein for retaining the wheels. The arrangement is repeated until multiple layers of nested wheels are provided and are positioned on a pallet.

5 Claims, 11 Drawing Sheets

NESTING WHEEL PACKAGING SYSTEM

TECHNICAL FIELD

The present invention relates to a system for shipping articles. More particularly, the present invention relates to a system for shipping wheels by nesting a wheel having a smaller diameter within a wheel having a larger diameter and by providing an appropriate structure to substantially restrain the large and small wheels from movement once nested.

BACKGROUND OF THE INVENTION

Global commerce requires that articles being shipped are securely and properly packaged to prevent damage during the shipping process, particularly during loading and unloading of the articles. In addition, it is know that shipping costs, whether by land, air or sea, are directly proportional to the size of the parts. In the particular case of vehicle wheels a large volume of aluminum wheels used in North American automobile production are currently produced in Asia requiring shipping over great distances through a variety of means.

Current packaging for the shipment of vehicle wheels is generally inefficient. Specifically, for wheels having a diameter of 15"-16" each shipping pallet contains 32 wheels while for wheels having a diameter of 17"-20" each shipping pallet contains only 16 wheels. This arrangement results in shipping inefficiencies of between about 30-45% per 40' ocean shipping container. A further restriction is imposed in that for wheels over 20" it is highly inefficient to have these articles produced in low-cost provider countries given the impracticality of moving such large wheels over long distances. All of these inefficiencies add considerable expense to the movement and thus to the cost of such articles.

Accordingly, a need exists today for an improved arrangement for shipping vehicle wheels over long distances.

SUMMARY OF THE INVENTION

The disclosed embodiments of the nesting wheel packaging system are generally directed to the nesting of a smaller wheel substantially inside a larger wheel while protecting the surface finish of the wheels from damage during all phases of shipment. The nesting arrangement in general doubles the shipping density of each pallet and achieves the maximum volume and weight limit for each 40' shipping container.

According to the disclosed embodiments, a smaller wheel is nested substantially within a larger wheel. The wheels have a partition disposed therebetween to prevent damage. The partitions may be of any of a number of variations and may have radially extending wings provided for ready adaptation to the configurations of the nested wheels. A plurality of sets of nested wheels is provided on a lower panel and an upper panel is positioned over the wheels to define a first layer or segment of wheels. Thereafter another layer of nested wheels is placed on top of the first layer or segment. The panels may have recessed areas defined therein for retaining the wheels. The arrangement is repeated until multiple layers of nested wheels are provided and are positioned on a pallet. Bands are applied to the assembly for shipping.

By employing the disclosed system it has been found that per container shipping efficiency improved from 55% to 98%. It is apparent that the general concept of the present invention can be applied to any wheels within compatible size ranges (that is, for any combination of larger and smaller wheels capable of being nested) and to wheels made of a variety of materials, such as aluminum as well as mini steel wheels.

Other features of the invention will become apparent when viewed in light of the detailed description of the preferred embodiment when taken in conjunction with the attached drawings and the appended claims.

BRIEF DESCRIPTION OF THE DRAWINGS

For a more complete understanding of this invention, reference should now be made to the embodiment illustrated in greater detail in the accompanying drawings and described below by way of examples of the invention wherein.

DETAILED DESCRIPTION OF THE PREFERRED EMBODIMENT

Figure 1:
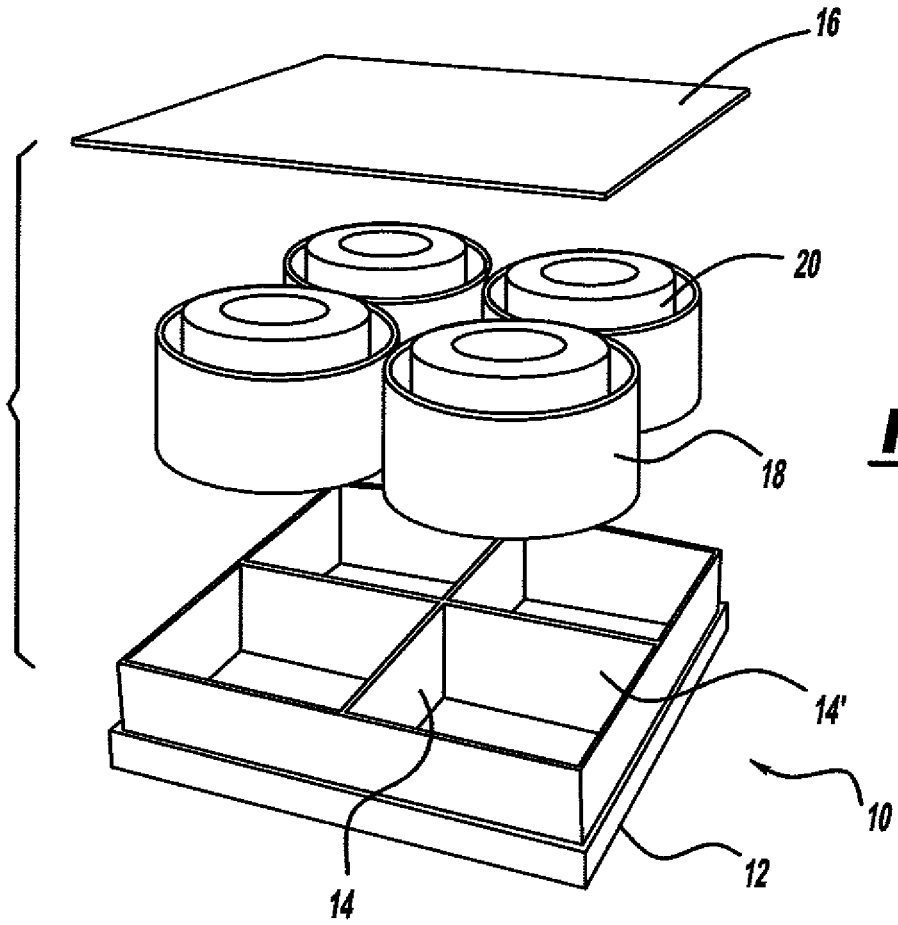
FIG. 1 illustrates exploded view of a first embodiment of the packaging system of the disclosed invention.

In the following figures, the same reference numerals will be used to refer to the same components. In the following description, various operating parameters and components are described for one constructed embodiment. These specific parameters and components are included as examples and are not meant to be limiting.

Figure 2:
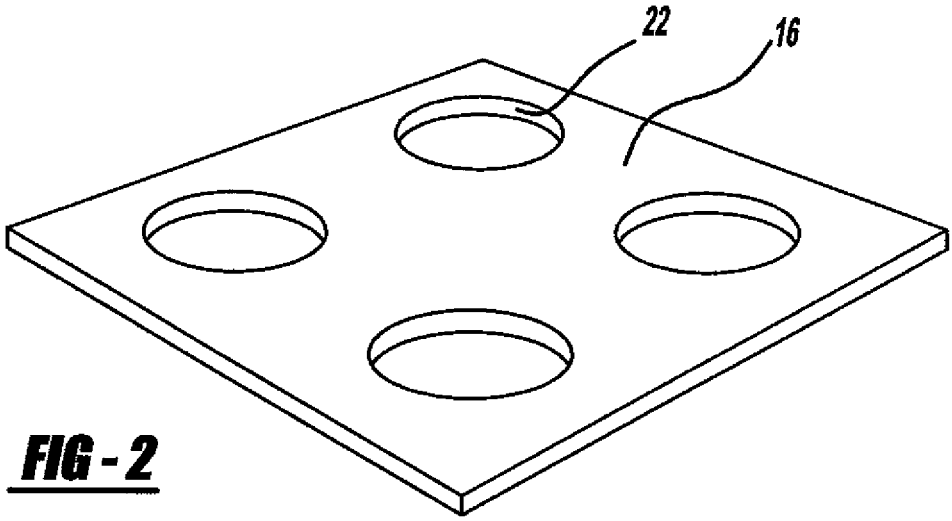
FIG. 2 is a view perspective view of a partition.

Referring to the drawings and in particular to FIG. 1, an exploded view of a first embodiment of the packaging system of the disclosed invention, generally illustrated as 10, is shown. The packaging system 10 includes a lower segment 12. The lower segment 12 includes a first wall 14 and a second wall 14'. The walls 14 and 14' intersect at the approximate middle and define individual wheel cells with each cell being configured so as to receive and restrain a large wheel 18 having a small wheel 20 nested therein. An upper panel 16 is provided to fit over the smaller wheels 20. A view of the upper panel 16 is shown in FIG. 2. Preferably the upper panel is composed of a honeycomb material for strength. As set forth in that figure, the upper panel 16 has a plurality of recessed areas 22 defined therein. Each of the recessed areas 22 is preferably die cut and configured so as to receive and restrain one of the small wheels 20. The lower segment 12 and the upper panel 16 may be composed of any of a variety of materials including wood or cardboard, although preferably a double walled corrugated cardboard is used.

While the lower segment 12 and the upper panel 16 are composed of an appropriate material to prevent damage to the outer portions of the wheels 18 and 20 and are configured so as to minimize shifting of the wheels 18 and 20 when packaged, it is desirable to provide an arrangement which prevents damage caused by one wheel directly contacting another wheel. Accordingly, a partition between adjacent wheels is provided.

Figure 3:
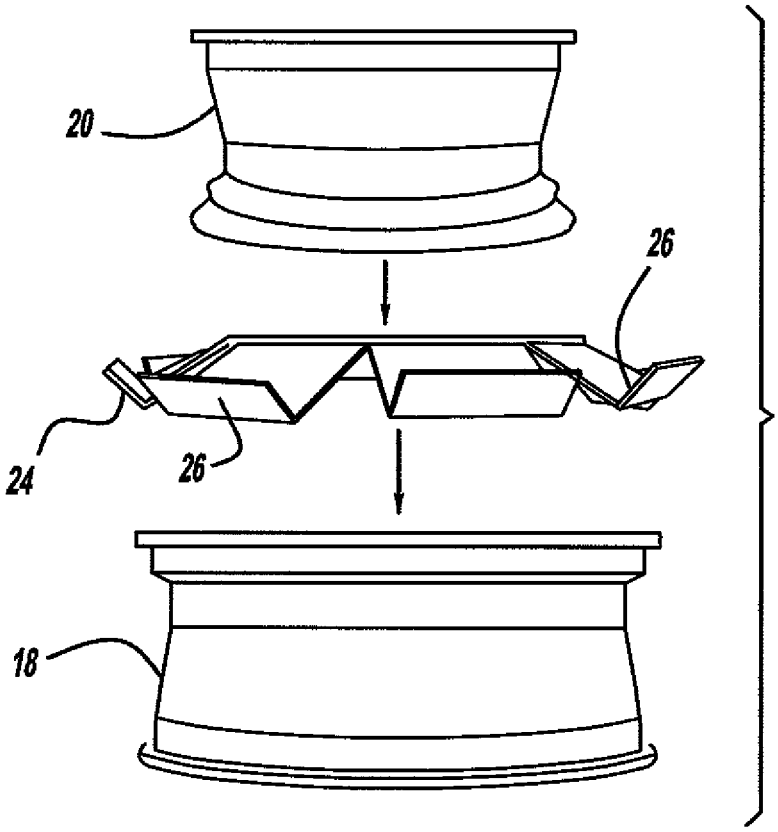
FIG. 3 is an exploded view of two spaced apart wheels having a first embodiment of a spacer shown in relation to the wheels.

With respect to FIG. 3, an exploded view of the wheels 18 and 20 showing a first embodiment of a partition 24 is illustrated. The partition 24 includes a plurality of semi-flexible wings 26 which extend radially from the body of the partition 24. The flexibility of the wings 26 allow for the partition 24 to generally conform to the interior surface of the wheel 18, thus permitting the wheel 20 to nest securely therein.

Figure 4:
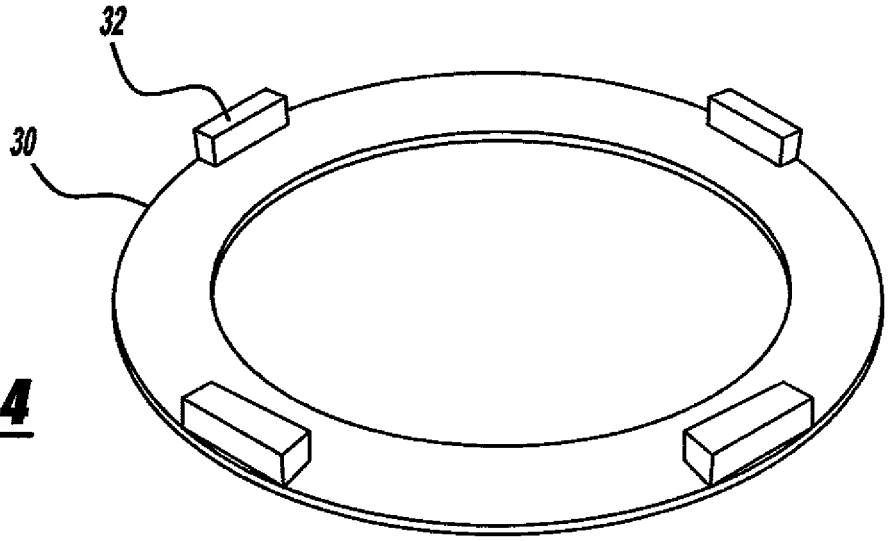
FIG. 4 is a perspective view of a second embodiment of a spacer for placement between two wheels.

An alternate embodiment of a partition is shown in FIG. 4. In this figure, a partition 30 is illustrated in perspective view. The partition 30 is substantially a ring having a plurality of flanges 32 extending therefrom. The flanges 32 in conjunction with the ring body act to keep the wheel 18 and the wheel 20 spaced apart from one another, thus preventing wheel-to-wheel contact in a manner similar to the partition 24 as set forth above.

Figure 5:
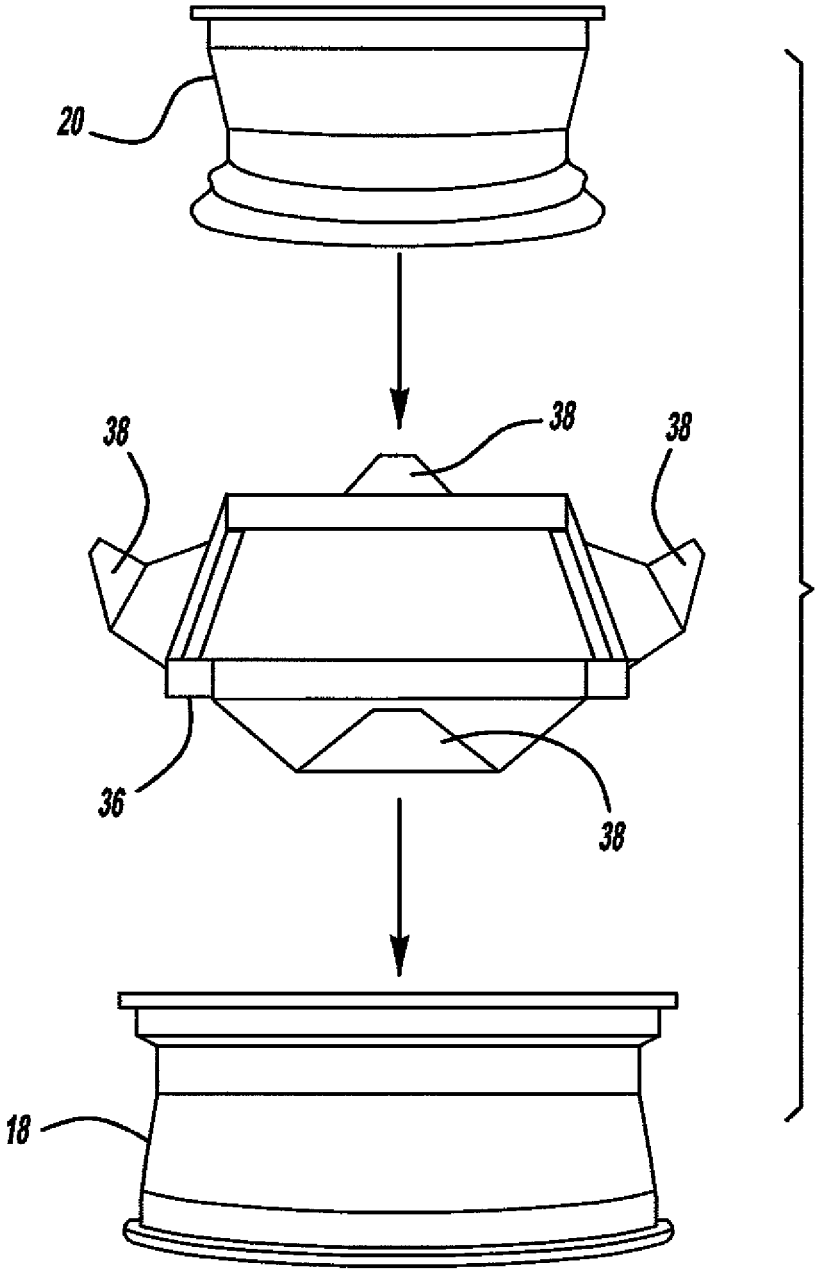
FIG. 5 is an exploded view of two spaced apart wheels having a third embodiment of a spacer shown in relation to the wheels.

A further alternate embodiment of a partition according to the disclosed invention is shown in FIG. 5. Shown in this figure is an exploded view of the wheels 18 and 20 having a third embodiment of the partition arrangement of the disclosed invention disposed therebetween. According to this embodiment a substantially square-shaped partition 36 is provided which includes a plurality of semi-flexible wings 38 extending therefrom. Like the wings 26 of the partition 24, the wings 38 allow the partition 36 to generally conform to the interior surface of the wheel 18.

Figure 6:
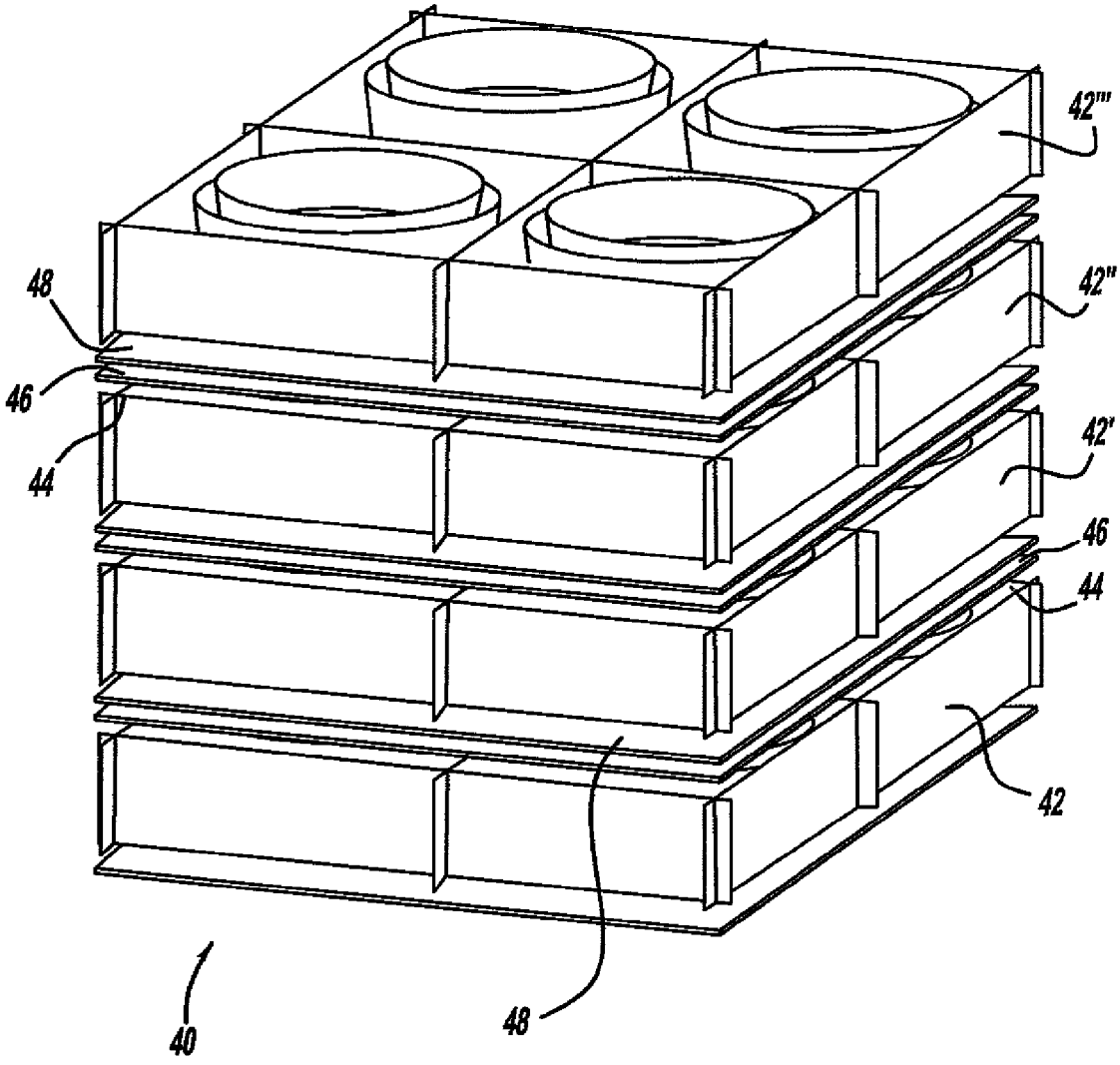
FIG. 6 is a perspective view of a series of wheel-holding segments placed one atop the other without the top panel in place according to the first disclosed embodiment of the packaging system.

After large wheels forming a first layer have been positioned in their respective cells and one of the partitions are placed in each of the large wheels, the small wheels are placed substantially within the large wheels. Each layer of wheels disposed in its respective packaging defines a segment. As shown in FIG. 6, a first embodiment of a shipping unit, generally illustrated as 40, includes a stacked plurality of segments. As illustrated there are four segments 42, 42', 42", 42'", shown in position one atop the other. A greater or lesser number of segments may be used and it is to be understood that the illustrated four segments is provided for illustrative purposes only.

Between each of the segments 42, 42', 42", and 42'" is one or more layers of an insulating material. Preferably, but not necessarily, the insulating material includes a paper pad 44, a foam sheet 46, and a layer pad 48. The foam sheet 46 preferably is composed of a polyethylene material while the layer pad 38 is preferably composed of a double-walled cardboard.

Figure 7:
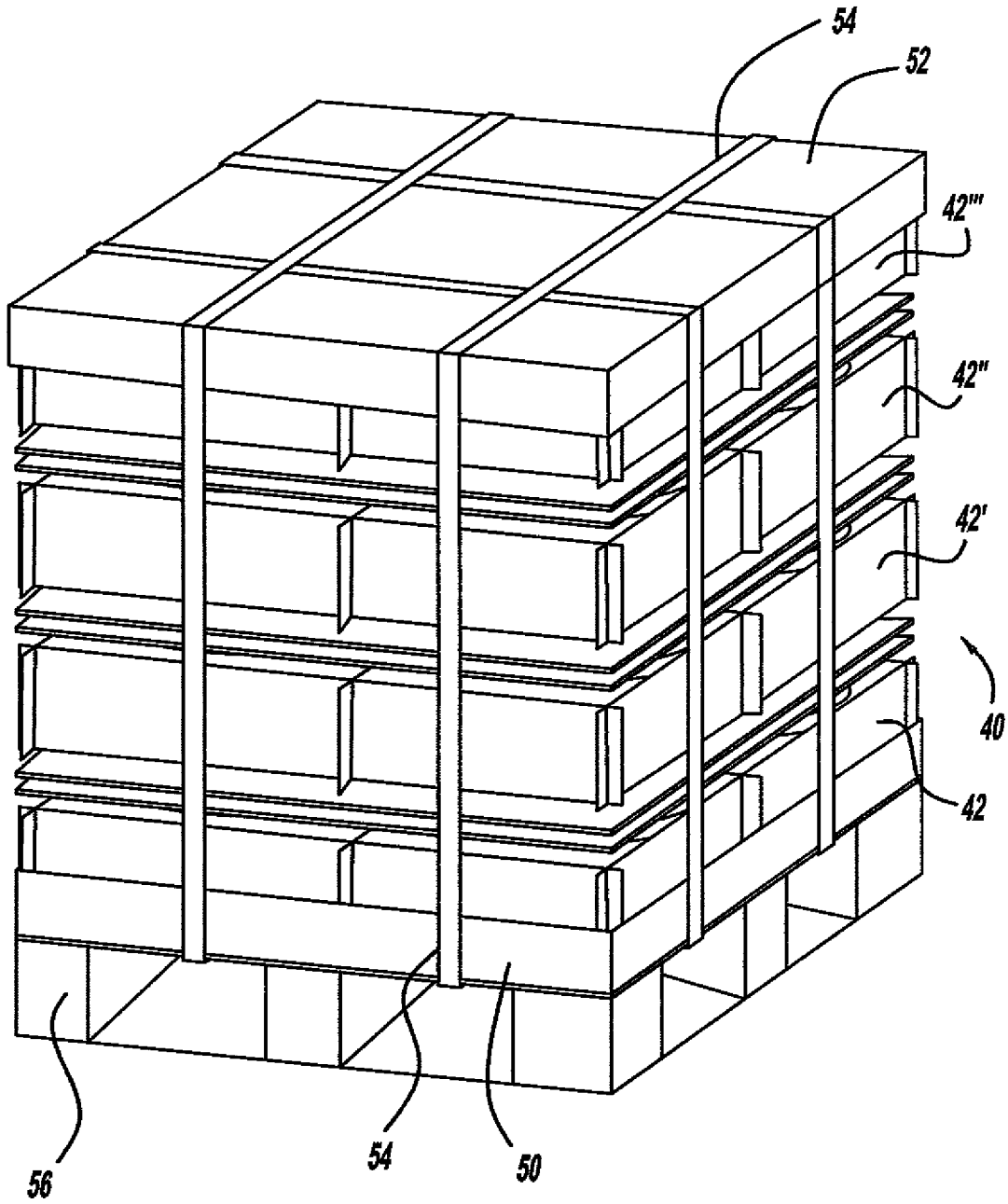
FIG. 7 is a view similar to that of FIG. 6 but showing the segments positioned on a pallet with the top panel in place and with the segments strapped to the pallet.

As shown in FIG. 7, the assembled segments 42, 42', 42", and 42'" are positioned between a lower panel 50 and an upper panel 52. The assembly is then positioned on a pallet 56. The pallet 56 may be composed of any of a variety of materials but is preferably composed of a fumigated softwood as is known in the art. The pallet 56 is wrapped in a plastic sheet. A plurality of bands 54 are then strapped around the assembly in a known manner.

Figure 8:
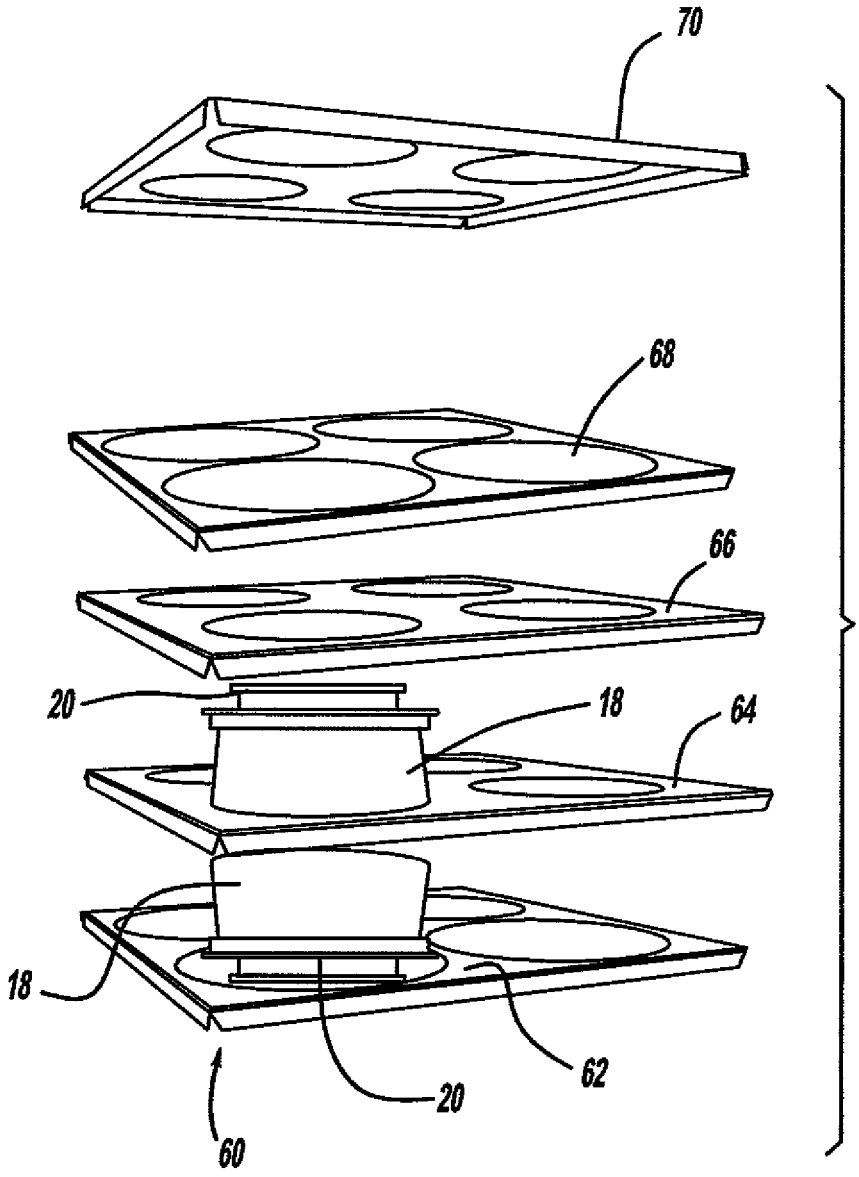
FIG. 8 illustrates an exploded view of a second embodiment of the packaging system of the disclosed invention.
Figure 9:
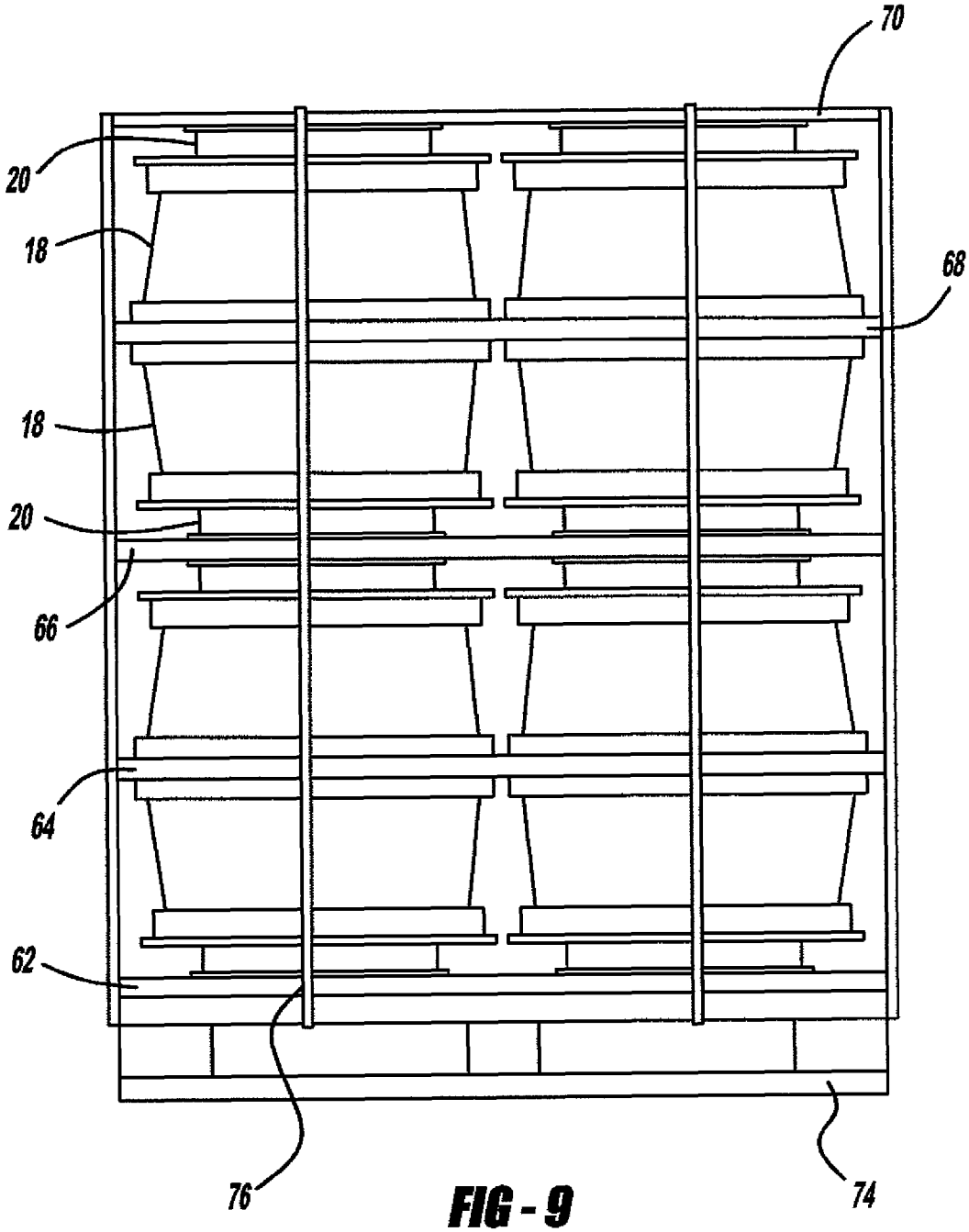
FIG. 9 a sectional side view of a series of wheel-holding segments placed one atop the other and strapped to a pallet according to the second disclosed embodiment of the packaging system.

As an alternative to the arrangement for stacking the wheels shown in FIG. 1 in which each nested pair of large and small wheels is stacked with another nested pair on top wherein the stacked large wheels all face in the same direction, the wheels may be stacked in alternating directions as shown in FIGS. 8 and 9. Particularly, and with respect to those figures, an exploded view of a second embodiment of the packaging system of the disclosed invention, generally illustrated as 60, is shown. The packaging system 60 includes a lower segment 62. The lower segment 62 preferably includes a plurality of die cut recessed areas for receiving and substantially restraining the small wheels 20. A partition (not shown) of the type shown in FIGS. 3 through 5 is then placed on each of the small wheels 20. The large wheels 18 are then placed over the partitions on the small wheels 20. Thereafter a layer pad 64 is disposed over the first layer of nested large and small wheels, thus defining a first segment. The layer pad 64 has a plurality of wheel receiving and restraining recessions formed therein on both sides. Once the layer pad 64 is in place, a layer of large wheels 18 is placed on the layer pad 64 in the appropriate recessed areas and partitions are placed in the large wheels 18. The small wheels 20 are then fitted substantially into the large wheels 18 and a layer pad 66 is placed over the nested wheels, thus defining a second segment.

As illustrated in FIGS. 8 and 9, the small wheels 20 of the first segment are beneath the large wheels 18 while in the second segment the small wheels 20 are placed above the large wheels 18. This arrangement is repeated to define two additional segments of wheels in which a layer pad 68 is fitted therebetween and the pattern of the first and second segments is repeated as is readily seen in FIG. 9. A top panel 70 is provided over the entire assembly of the four segments and a pallet 74 is disposed beneath the whole assembly. A pair of straps 76 and 76' is attached to retain the lower panel 62, the top panel 70 and all of the wheels and layers disposed therebetween on the pallet 74.

Figure 10:
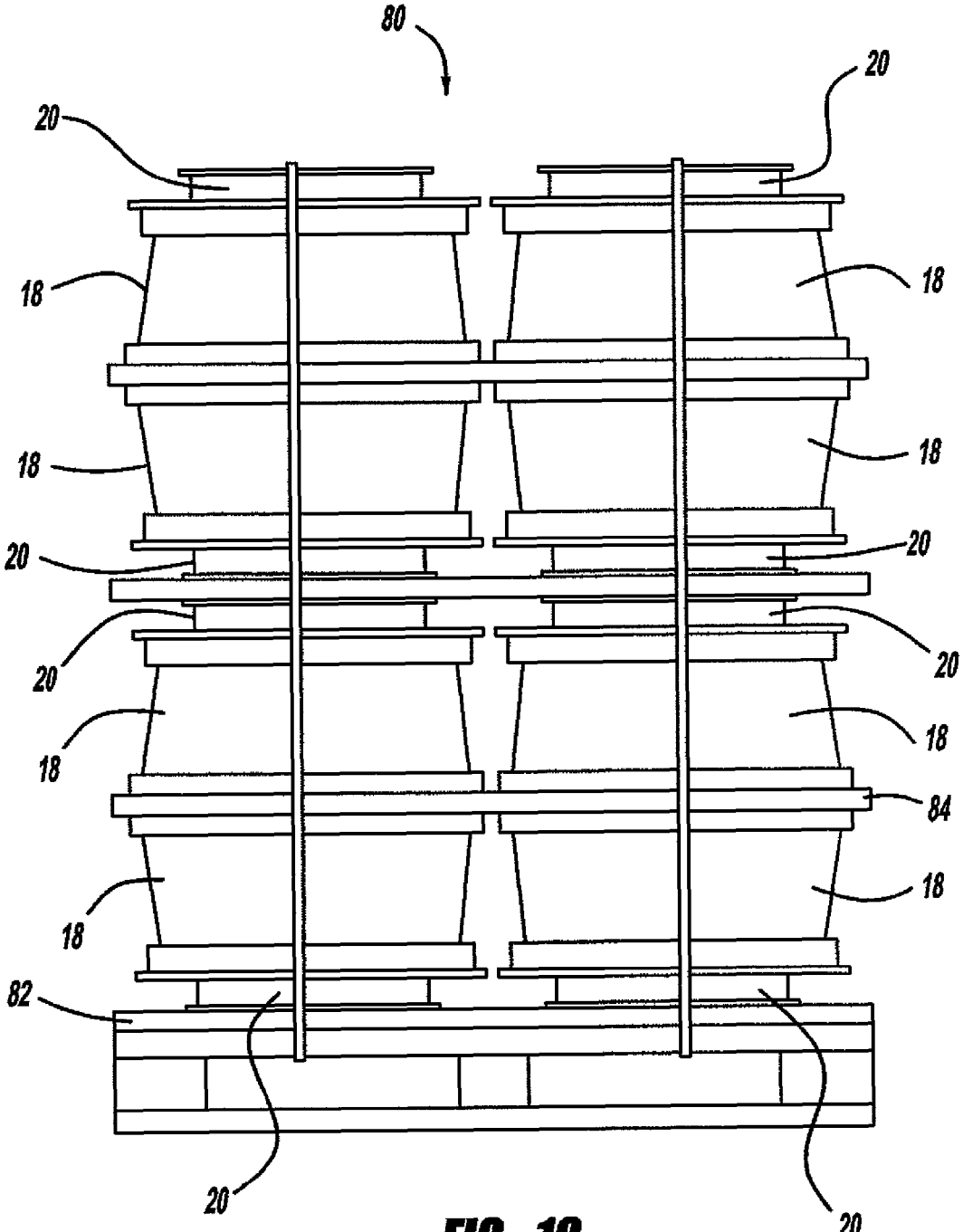
FIG. 10 is a sectional side view of a series of wheel-holding segments placed one atop the other and strapped to a pallet according to a variation of the second disclosed embodiment of the packaging system of the present invention illustrated in FIG. 9.

With reference to FIG. 10, an arrangement similar to that of FIG. 9 is illustrated in which the small wheels 20 are substantially positioned within the large wheels 18. Specifically, a variation of the second embodiment of the packaging system of the disclosed invention, generally illustrated as 80, is shown. The packaging system 80 includes a base segment 82. The base segment 82 preferably includes a plurality of die cut recessed areas for receiving and substantially retaining the small wheels 20. A partition (not shown) of the type illustrated in FIGS. 3 through 5 is then placed on each of the small wheels 20. The large wheels 18 are then placed over the partitions of the small wheels 20. Thereafter a layer pad 84 is positioned over the first layer of nested large and small wheels, thus defining a first segment. The layer pad 84 has a plurality of wheel receiving and restraining recessions formed therein on both sides. Once the layer pad 84 is in place, a layer of large wheels 18 is placed on the pad layer 84 in the appropriate recessed areas and partitions are placed in the large wheels 18. The small wheels 20 are then fitted substantially within the large wheels 18, thus defining a second segment. According to the embodiment of FIG. 10 no additional layer pad is placed on the top of the second segment. Instead, a pair of straps 86 and 86' is attached to retain the base segment 82 to the wheels and segments disposed thereupon.

Figure 11:
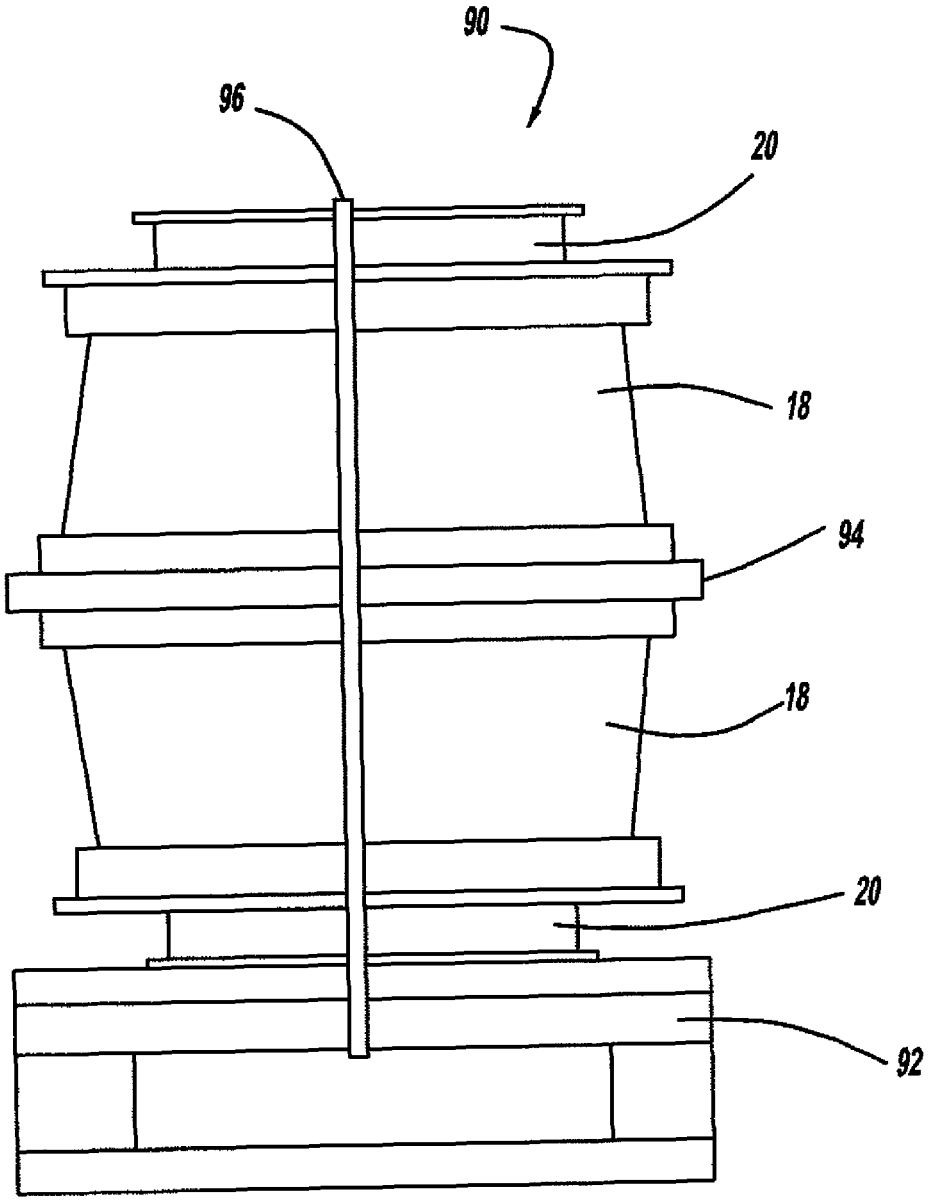
FIG. 11 is a sectional side view of a pair of nested wheels placed one atop the other and strapped to a pallet according to a third disclosed embodiment of the packaging system.

FIG. 11 provides yet a further variation of the wheel nesting arrangement of the present invention. Particularly, a third disclosed embodiment of the packaging system, generally illustrated as 90, is shown. The packaging system 90 includes a base segment 92. The base segment 92 preferably includes a die cut recessed area (not shown) for receiving the small wheel 20. A partition (not shown) of the type illustrated in FIGS. 3 and 5 is then placed on the small wheel 20. The large wheel 18 is then placed over the partition of the small wheel 20. Thereafter a layer pad 94 is positioned over the large wheel 18, thus defining a lower segment. The layer pad 94 has a wheel receiving and restraining recession formed therein on both sides. Once the pad layer 94 is in place, the large wheel 18 is placed on the pad layer 94 and a partition is placed in the large wheel 18. The small wheel 18 is then fitted substantially within the large wheel 18, thus defining an upper segment. A strap 96 is attached to retain the base segment 92 to the wheels as illustrated.

Figure 12:
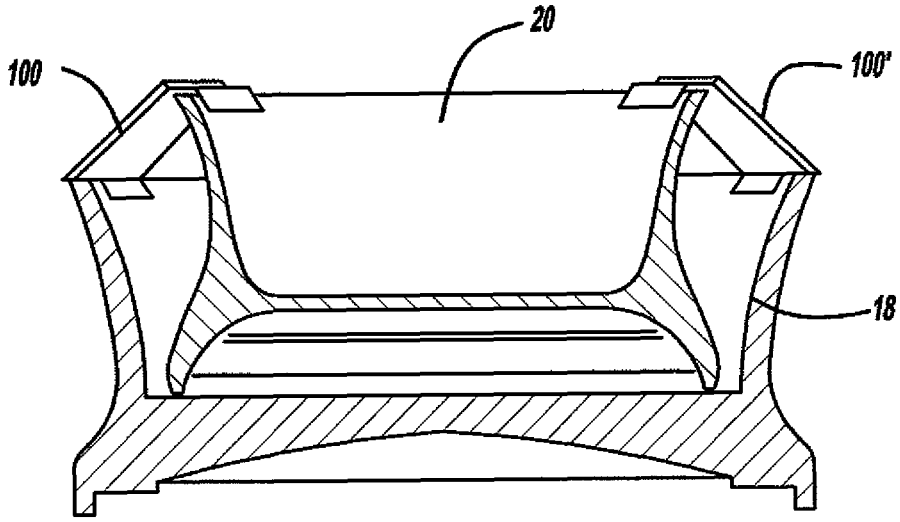
FIG. 12 is a sectional view of a smaller wheel nested within a larger wheel, the smaller wheel and the larger wheel being retained with respect to each other by a connecting feature according to a fourth disclosed embodiment of the packaging system.
Figure 13:
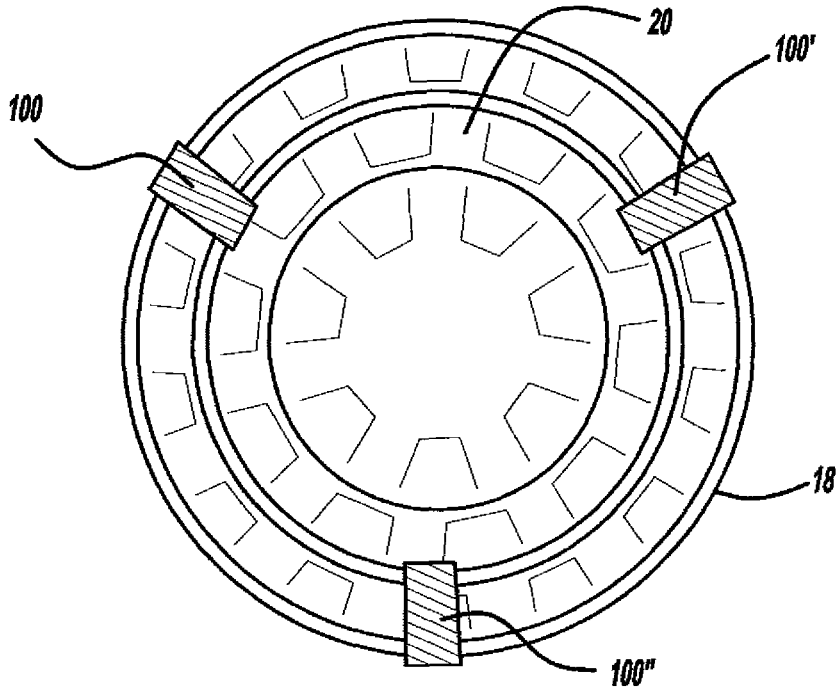
FIG. 13 is a top plan view of the arrangement of FIG. 12.

A further variation of the packaging system of the disclosed invention is illustrated in FIGS. 12 and 13 in which a fourth embodiment of the system is shown. With reference to those figures, the small wheel 20 is substantially nested within the large wheel 18 as illustrated and discussed above. To retain the small wheel 20 in the large wheel 18 a connecting feature is provided. Particularly, connecting features 100, 100' and 100" are provided. It is to be understood that while three connecting features 100, 100' and 100" are shown, a greater or lesser number may be provided.

Figure 14:
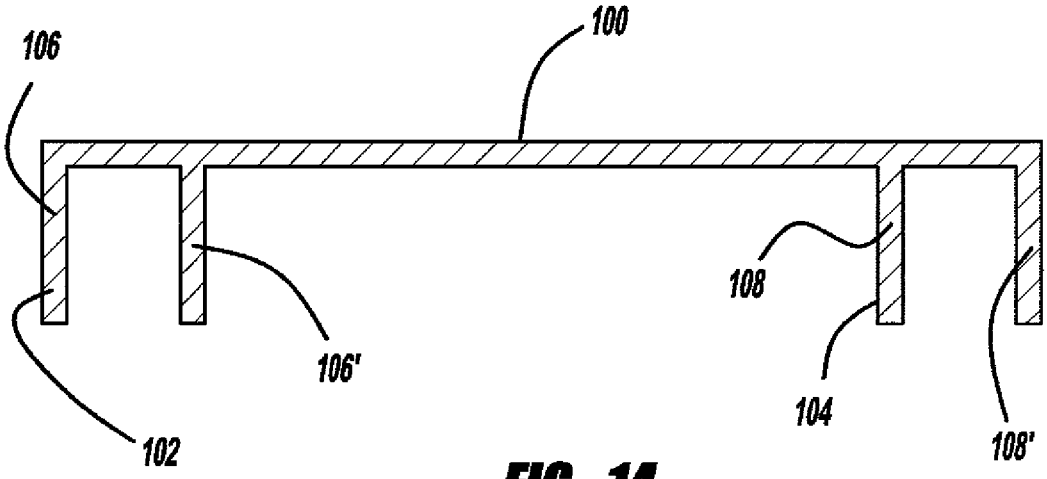
FIG. 14 is a sectional view of the connecting feature of FIGS. 12 and 13.
Figure 15:
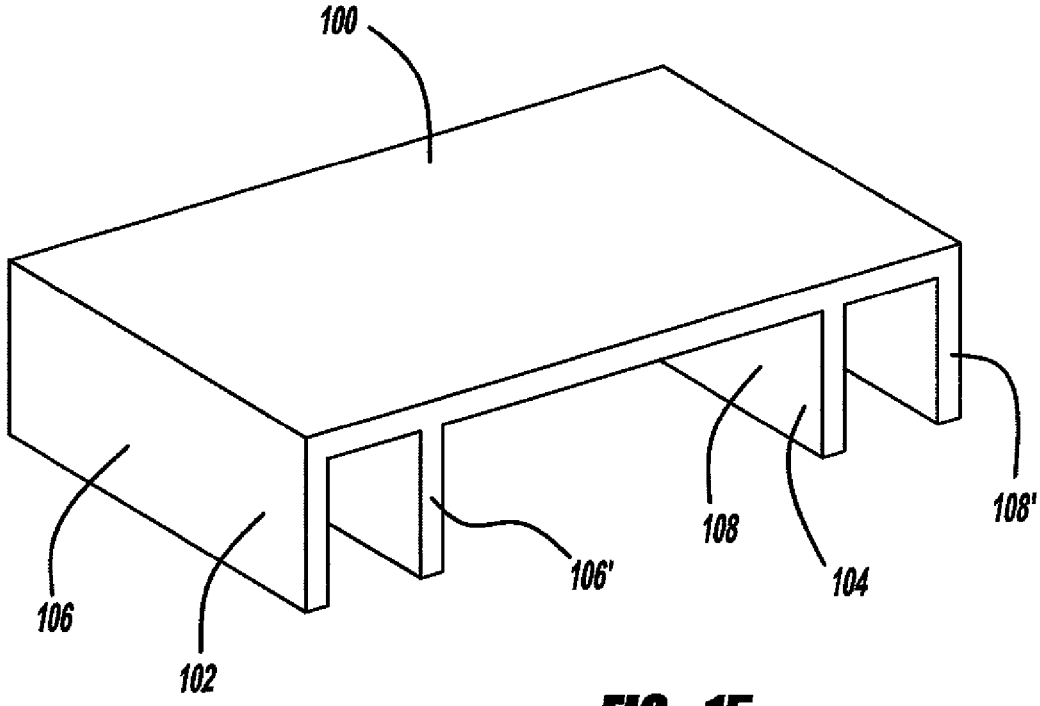
FIG. 15 is a perspective view of the connecting feature of FIGS. 12, 13 and 14.

With reference to FIGS. 14 and 15, details of the connecting features 100, 100' and 100" are illustrated for better understanding. FIG. 14 illustrates a sectional view of the connecting feature 100 and FIG. 15 illustrates a perspective view of the connecting feature 100. While the connecting feature 100 is illustrated in FIGS. 14 and 15 it is to be understood that the connecting features 100' and 100" are of the same construction and arrangement.

With reference to FIGS. 14 and 15, the connecting feature 100 includes a pair of spaced apart channels 102 and 104. The channel 102 is defined by a pair of spaced apart channel walls 106 and 106'. The channel 104 is defined by a pair of spaced apart channel walls 108 and 108'. The channels 102 and 104 are configured so as to grip the outer edges of the wheels 18 and 20 respectively. Preferably the connecting features 100 is composed of a resilient polymerized material. It is to be further understood that variations of the connecting features 100, 100' and 100" such as springs or the like may be substituted for the illustrated components.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A packaging system for packaging different-sized wheels comprising:

a first wheel having a diameter;

a second wheel having a diameter smaller than said diameter of said first wheel, wherein the second wheel comprises a first side that generally opposes a second side, and wherein the first side is nested inside the first wheel;

a first frame to hold said first wheel, said first frame including wheel-holding area for substantially restraining said first wheel, said wheel holding area having a width;

a second frame to hold said second wheel, said second frame including a recessed area for substantially restraining said second wheel, said recessed area having a diameter that is smaller than said width of said wheel-holding area of said first frame;

an attachment feature for securing one of the first or second wheels to the other of the first or second wheels by nesting and for further securing the wheels to said first and second frames; and a partition fitted between the first and second wheels, said partition including a central body and a plurality of semi-flexible wings extending radially from said body, the central body having a width substantially similar to a width of the first side of the second wheel that is nested inside the first wheel.

2. The packaging system of claim 1 including plural layers of nested first and second wheels.

3. The packaging system of claim 2 in which the first wheel is the lower wheel in each of said layers of nested first and second wheels.

4. The packaging system of claim 2 in which the plural layers defines at least two layers comprising a lower layer and an upper layer and in which the first wheel is the lower wheel on one of said at least two layers and in which the second wheel is the lower wheel on the other of said at least two layers.

5. The packaging system of claim 1 further comprising, a connecting feature that connects the first wheel to the second wheel, the connecting feature having a first channel, which secures onto an outer edge of the first wheel, and a second channel connected to the first channel that secures onto an outer edge of the second wheel.

* * * * *